United States Patent [19]

Belanger

[11] 4,074,285

[45] Feb. 14, 1978

[54] PHOTOCOMPOSING MACHINE WITH MOVABLE CHARACTER STORAGE AND PRESENTATION APPARATUS

[75] Inventor: Raymond Francis Belanger, Lawrence, Mass.

[73] Assignee: Graphic Systems, Inc., Hudson, N.H.

[21] Appl. No.: 692,743

[22] Filed: June 4, 1976

[51] Int. Cl.[2] ..... B41B 15/16

[52] U.S. Cl. ..... 354/15; 354/13

[58] Field of Search ..... 354/14, 15, 13, 16, 354/18, 19, 10, 292; 346/138; 352/82, 83, 233

[56] References Cited

U.S. PATENT DOCUMENTS

| | | | |
|---|---|---|---|
| 2,790,362 | 4/1957 | Higonnet et al. | 354/19 |
| 3,626,423 | 12/1971 | Ameen | 354/16 X |
| 3,693,516 | 9/1972 | Aron et al. | 354/15 X |
| 3,738,236 | 6/1973 | Grube et al. | 354/15 |
| 3,988,746 | 10/1976 | Friedman | 354/16 X |

*Primary Examiner*—Edna M. O'Connor

[57] ABSTRACT

This disclosure depicts character storage apparatus especially for use in a phototypesetting machine or the like for storing characters for selective presentation at a character display location, including a plurality of discrete character carriers each carrying a plurality of rows of characters or character fonts which move in a close path of motion when the phototypesetting machine is in operation. The apparatus includes apparatus to move the character carrier from one position to another including from one row of characters to another row of characters with extreme accuracy. The character carries are mounted on a rotating drum and the moving apparatus includes a gimbal assembly for tilting the drum.

11 Claims, 5 Drawing Figures

PHOTOCOMPOSING MACHINE WITH MOVABLE CHARACTER STORAGE AND PRESENTATION APPARATUS

BACKGROUND OF THE INVENTION

The art of photocomposing probably originated almost as early as the art of photography. In the late 1800's photographic output for a telegraph system was devised. Instead of hitting mechanical keys to print a message, the system used a photographic exposure of the letters to be printed. Since that time, serial printing of characters and other information by photography developed relatively slowly until the time was reached when science and engineering was ready for it. In the 1930's high intensity flash sources were developed so that all of a sudden it became possible to make a photographic exposure of a moving object and stop its motion in flight. At roughly the same time, logic circuitry began to develop to the point where it was possible to make a rapid selection of one of a number of objects and to select such objects at a precise time and position. Accordingly, in the mid 1940's, several people, virtually simultaneously, developed photocomposing machines which operated with moving images of alphanumeric characters, selecting these characters at relatively high speed and stopping the motion with a strobe flash. In relatively quick succession, at least three different photocomposing machines of this sort came into being as evidenced by Tansel, U.S. Pat. No. 2,725,803, Higonnet and Moyroud, U.S. Pat. 2,790,362, and Perry U.S. Pat. No. 2,876,687. Machines of the sort related to these patents have been developed during the years and have found an increasing place in the market. The art of photocomposing is steadily growing as a significant new way of generating a printing master.

Most recently with improvements in computers and automation, it is becoming possible to compose type by means of photocomposition at increasing speeds and with increasing quality of result. It is now possible to compose type either from a keyboard or coded signal input, which may be derived from punched tape or magnetic tape or from a source such as a transmission wire, and to compose the type with final printing quality such that it is almost indistinguishable from letter press printing and in many instances better than letter press.

One type of phototypesetting apparatus presently in commercial use includes a character storage drum as shown in Tidd, U.S. Pat. No. 3,721,174 which carries on a film strip a plurality of character fonts arranged in tandem around the periphery of the drum. The drum is rotated rapidly to bring the characters in sequence before an optical imaging system illuminated by a quickly pulsed light source. A particular character is selected by causing the light source to be pulsed when that character is registered with the imaging system. The end product of such phototypesetting apparatus is a photographic printing plate.

In the practice of phototypesetting, as with all typesetting, a large number of type fonts are made available for selective use according to the specifications of particular jobs. It is desirable that phototypesetting machines have the capability of selecting a character from the greatest possible number of fonts with the least expenditure of time and labor.

Many drum-type phototypesetting machines have the capability of storing a number of fonts in tandem around the periphery of the character storage drum; however, in general such machines require that the font combinations be preassembled and placed on a master film strip which is then secured on the periphery of the drum. In one commercially available machine, font interchangeability is provided by use of film strips carrying individual character fonts which are attached separately to the periphery of a drum and aligned by means of registration pins.

However, the described arrangement for providing individual font replacement or interchange has certain deficiencies. First, the accuracy with which the character fonts can be positioned and held on the drum, initially and especially after a period of use, is not acceptable. Secondly, the described arangement for providing selective replacement of individual character fonts is unnecessarily time consuming and laborious. Thirdly, it has been found that because of the dimensional flexibility of a film strip it is apt to bow, warp, or be otherwise distorted at high rotational speeds. This is particularly serious when the effect is to distort the registration between the characters and associated timing marks which customarily accompany the characters on a font strip. The problem of accurate location of the characters on the drum is particularly acute in machines having the capability of magnifying characters.

In Tidd, U.S. Pat. No. 3,721,174, discrete character carriers, each carrying a font of characters dispersed on a cylinder of revolution when the photocomposing machine is in operation, is disclosed as a high accuracy character storage and presentment device. The problem arising with this device is that it still can accommodate only a limited selection of characters and character fonts, somewhat fewer than are desired in todays high-speed machines.

In order to increase flexibility of the photocomposing machine a greater amount of characters and character fonts are required. A solution to increase the number of characters stored for certain foreign language applications was achieved in Ebner, U.S. Pat. No. 3,893,132. In this system, mirrors were used as the track selector device to position the appropriate character from a particular row of characters. A plurality of these mirrors each inclined at a slightly different position with respect to its rotatable platform so that each mirror when moved into position receives a selected flash from a single row of characters.

In another commercially available machine discs containing a plurality of font rows are attached to a mounting member which is perpendicularly attached to a movable arm. Consequently, the entire disc and support members are caused to move so that the machines optical path is approximately perpendicular to the surface of the entire disc.

GENERAL NATURE OF THE INVENTION

The present invention is a new and improved photo recording or display machine such as, for example, a photocomposing machine having a rapidly moving character carrier means to flash a selected character and to project an image of said selected character to a single location and means to move the optical output of said system along a scanning line. The character carrier means is a movable member such as a rotatable drum or a rotatable drum containing a plurality of discrete individually replaceable carrier segments upon each of which is mounted a strip of film containing a plurality of rows of characters or character fonts. The characters are selected from a row by altering the position of the drum so as to register and position the selected character in front of the fixed optical flash system. In a now preferred embodiment of the invention, the rotating member is moved by tilting it from one position to another.

The tilting mechanism consists of a gimbal assembly, which supports the spindle for the character drum, mounted to a gimbal housing and movably attached thereto by use of a plurality of bearings. Attached to the gimbal housing are actuating means such as a plurality of solenoids, where upon activation the solenoid plunger causes the gimbal assembly to move about its axis on the bearings into the proper registered position.

The nature of the invention is more completely illustrated in the accompanying drawings in which.

DETAILED DESCRIPTION OF THE INVENTION

Figure 1:
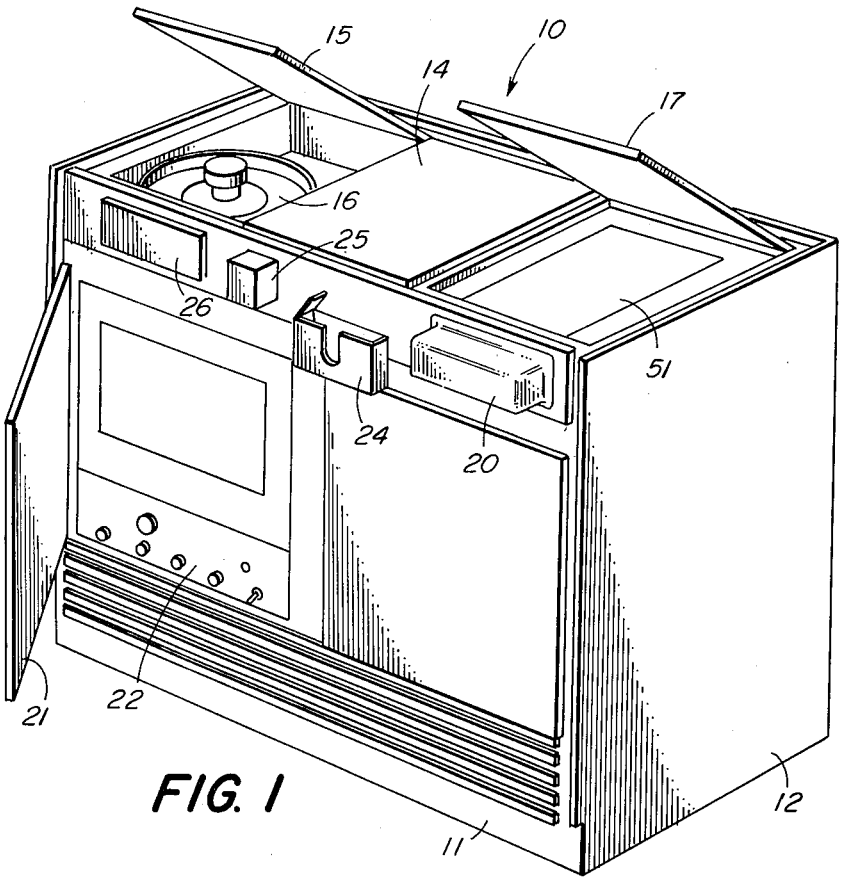
FIG. 1 is a perspective view of a photo composing machine according to one embodiment of the invention.

In FIG. 1 is a photocomposing machine as typically used with the present invention generally designated 10 including a front wall 11, side walls 12, back walls (not shown) and top walls 14. The back wall is not shown, and in fact may be partly or completely open if desired to permit easy access to the internal portions of the machine for repair, maintenance and service. As illustrated, the top wall 14 has a hinged panel 15 providing access to a character carrier or drum 16. A second top hinged panel 17 provides access to a photo printing panel location 19 adapted to receive and support photographic film paper or other photo recording means which is adapted to be received and wound up in a take up cassette 20 positioned at the front of the cabinet.

A front panel 21, also hinged, provides access to a control panel 22 which is positioned for operator convenience at the front of the photo composing machine. Convenience accessories 24, 25 and 26 for operator convenience may, if desired, be mounted on the machine cabinet.

Figure 2:
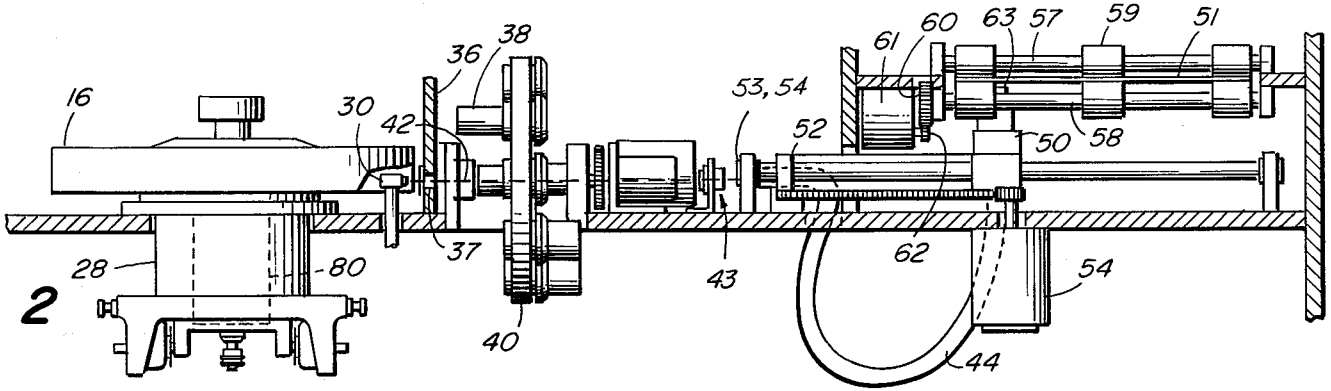
FIG. 2 is a diagrammatic front view of a portion of working parts of the machine shown in FIG. 1.
Figure 3:
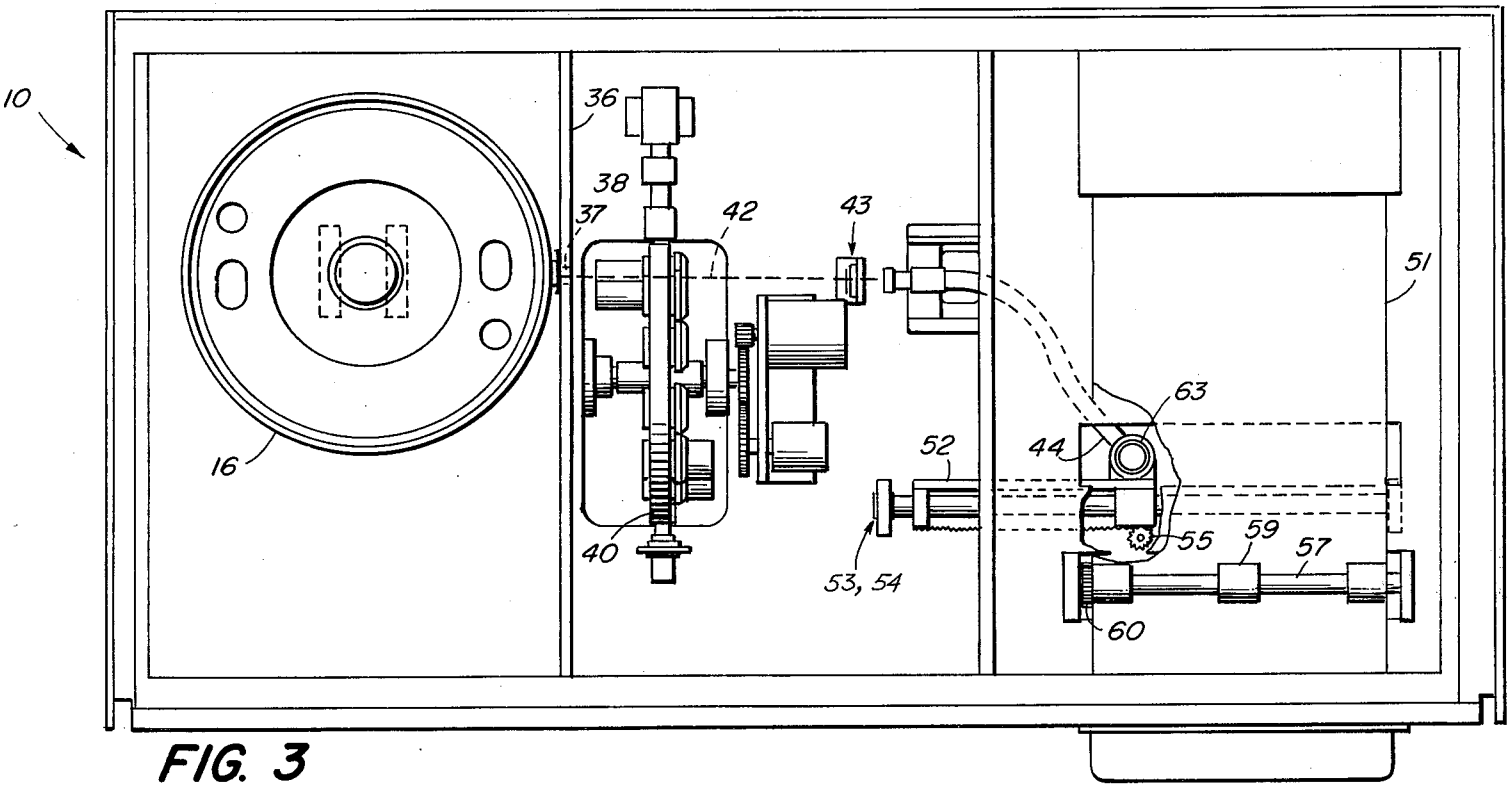
FIG. 3 is a top view of the machine shown in FIG. 1, partly in section.

In FIGS. 2 and 3 are illustrated the mechanical and optical chain of a photo composing machine that is typically used in conjunction with the present invention. This machine, in practice, employs a single character drum 16 adapted to be rotated on a tilting drum mechanism 28 which is driven by a motor attached to pulley 81 by a drive belt (not shown). The pulley 81 is attached to the spindle 80 which supports the drum and transfers the rotational drive from the drive motor to the character carrier. According to other embodiments of the invention, the machine, may, if desired, have a plurality of such character drums 16. Positioned near the bottom edge of the drum 16 and within the drum facing outwardly, is a flash lamp 30 adapted to provide an extremely short duration flash. Ordinarily, a xenon lamp is employed, but of course, other forms of strobe lights, or if desired, lasers, may be used. The lamp has a sufficiently short duration of flash so that it stops the motion of the drum, and it also has sufficient intensity of flash so that when flashed through the optical system and projected onto a photo receptor, it will produce sufficient photo response in the receptor. Mounted on drum 16 are four discrete interchangeable character holders 32, 33, 34 and 35 each containing a character font or, in the alternative, a portion of a font or one or more fonts so that character fonts or styles can be changed either by interchanging such shoes or mounting means or by interchanging the entire drum. A drum of this type with interchangeable fonts is shown in U.S. Pat. No. 3,721,174.

Positioned adjacent to drum 16 is a baffle 36 having an aperture 37 positioned adjacent to a font strip on drum 16 and adapted to pass light from the font strip through the aperture and the remainder of the optical chain.

A plurality of projection lenses 38 is mounted on turret 40, each lens being of a different focal length and each being positioned so as to project an image at a predetermined magnification from the film strip 41 along a projection axis 42 to a fixed input end 43 of the fiber optic bundle 44.

In accordance with an invention described and claimed in Tidd, U.S. Pat. No. 3,631,774, means are provided for accurately indexing the turret 40 upon command so as to position a selected one of the plurality of lenses 38 precisely on the projection axis 42. To this end, there is provided turret monitoring means for coarsely determining when a selected one of the lenses 38 is approaching the projection axis, and switching means for determining when the selected lens is substantially on the projection axis. The outputs from the turret monitoring means and the switching means are fed to an electronic control circuit which effects energization of a turret drive motor and actuates an accurate locking device to lock the turret 40 with the selected lens precisely on the projection axis 42.

At the output end of the optical systems is a carriage assembly shown in FIGS. 2 and 3.

The photo printing panel 19, comprises means to mount the output end 50 of the coherent fiber optical bundle 44 movable in a stepwise scanning mode and means to mount a photosensitive recording material 51 preferably movable at a 90° angle to the scanning motion of the bundle end 50, all as hereinafter described.

A carriage 52 supporting the bundle end 50 is movably mounted on guide rods 53 and 54 which are, in turn, mounted on the machine frame transverse to the path of the photosensitive material. A stepping motor 54 drives a pinion 55 operably engaging a rack 56 which transports the carriage 52 and thus the output end 50 of the bundle 44 across the photosensitive material 51.

Positioned on the recording station are an idling upper shaft 57 and a driven lower shaft 58. The shafts 57 and 58 carry sheet feed rollers 59 operable to convey a sheet or web of photosensitive material 51 across the recording station in a direction at right angles to the direction of motion of carriage 51. A drive gear 60 mounted on lower drive shaft 56 is driven by a stepping motor 61 through an intermediate gear 62.

The output terminal end 50 of the fiber bundle 44 preferably terminates in a relay lens 63 (see FIG. 2) positioned to focus onto the photosensitive material 51 the character images transmitted by the fiber optics bundle 44.

Figure 4:
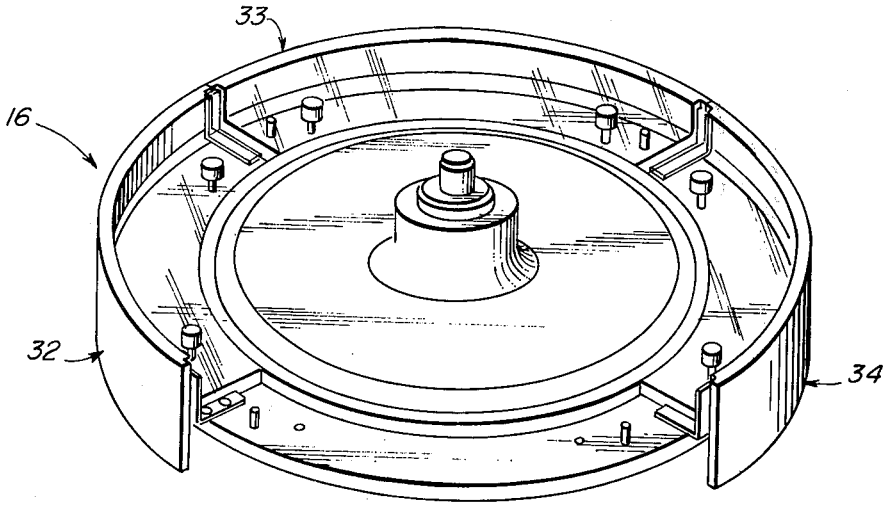
FIG. 4 is a perspective view, partially exploded illustrating the character storage apparatus with a plurality of character font and associated timing marks.
Figure 4:
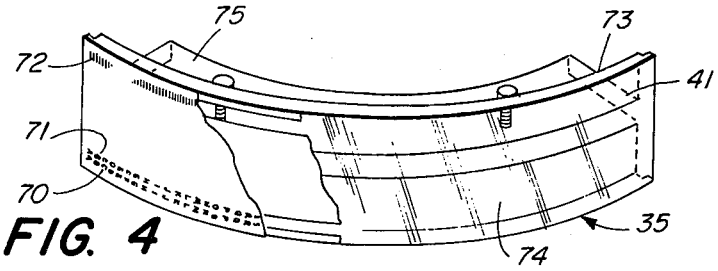

FIG. 4 illustrates the character storage drum 16 with the discrete interchangeable character holders 32, 33, 34 and 35 is mounted upon a tilting drum mechanism 28 being the essence of my invention. The drum segments 32, 33, 34 and 35 each function as character carriers each carrying a plurality of character fonts or characters of the same font.

Whereas any of a number of means may be employed for disposing characters on the segments 32, 33, 34, 35 in the illustrated preferred embodiment, the characters are recorded on a strip 41 of photograhic film. In addition to the rows of characters 70 and 71, each strip of photograhic film contains a row of timing marks 72 associated with the characters 70 and 71, for providing information useful to a phototype setting machine's control center in determining the particular character which is located at a predetermined character display station at a given instant. For a description of the associated system as a whole reference may be had to U.S. Pat. No. 3,631,774.

Each of the drum segments, 32, 33, 34 and 35 includes a cylindrical portion 73, the outer surface 74 of which supports the characters 70 and 71, and a radially extending web connected to the cylindrical portion 73. It can be seen that the characters rotate on a path of revolution which includes the outer surface 74 of the cylindrical portions 73 of the drum segments. Each character is thus presented to the associated character imaging system (not shown) at the same radial distance from the drum axis, and consequently at the same axial position in the imaging system.

In order to provide room within the drum for a light source for illuminating the characters, the web 75 of each segment is connected to the cylindrical portions 73 asymmetrically. It has been found that this asymmetry causes a distortion of the drum 16 at high rotational speeds. To counterbalance the drum, weights (not shown) are added thus eliminating distortion.

Figure 5:
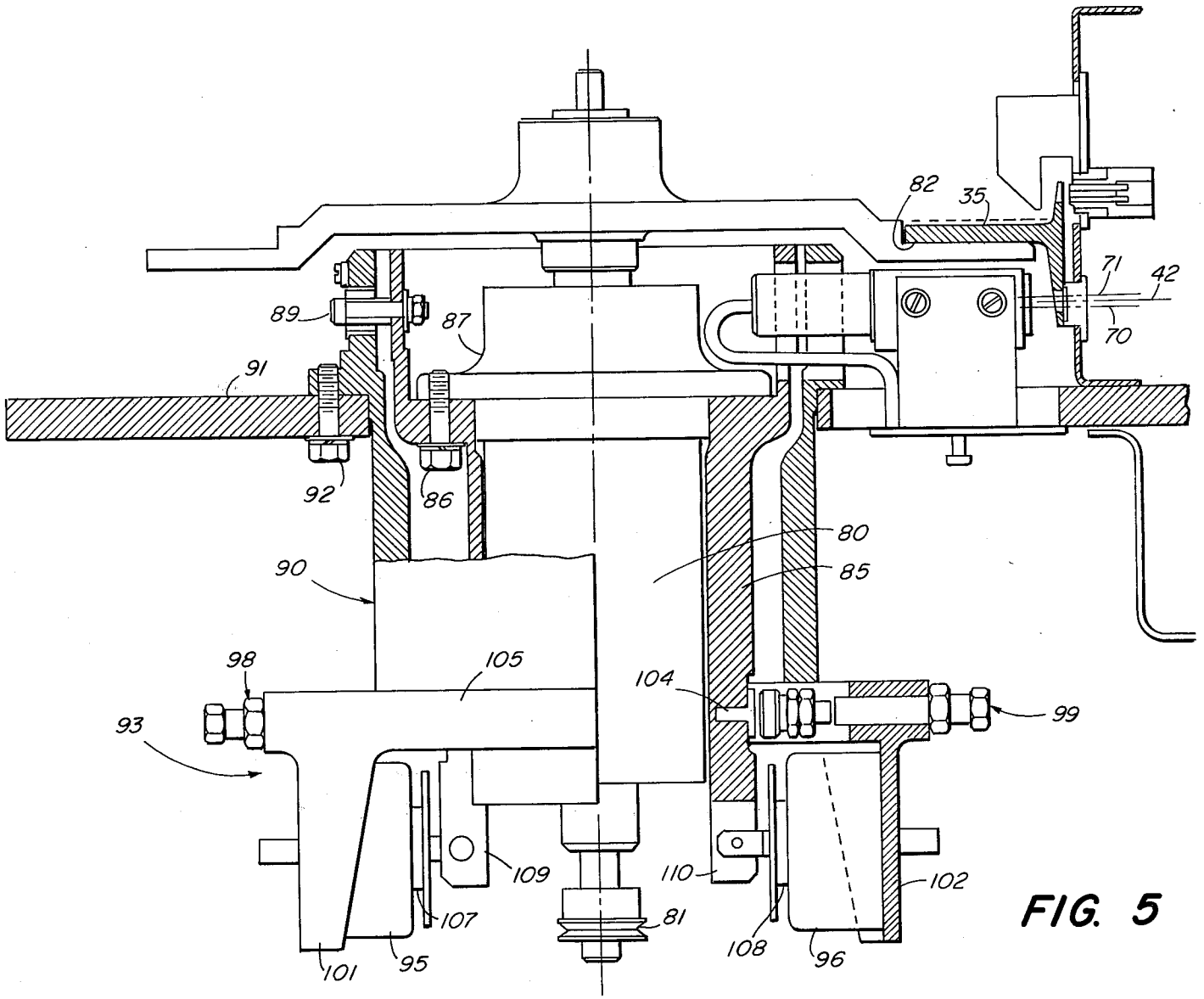
FIG. 5 is a front view of the tilting drum mechanism, partly in section, being the essence of my invention.

In Fig. 5 is shown a presently preferred embodiment of a tilting drum mechanism 28 according to my invention. The character drum 16 is caused to rotate about its vertical axis by a drive motor connected to a drive belt attached to pulley 81 which is attached to spindle 80. The character drum 16 has mounted along mounting surface 82 the discrete interchangeable character holders 32, 33, 34 and 35. Along the exterior surface 83 of the discrete character holder 32 is mounted a film strip containing at least two rows of characters 70 and 71 and one row of timing marks 72. The rows of characters are approximately 0.075 inches off center from the projection axis 42. In the preferred embodiment, one row of characters 71 being above said center line by 0.075 inches and the other row of characters 70 below the center line by 0.075 inches.

Beneath the character drum 16 and supporting thereto is the gimbal assembly 85. The gimbal assembly 85 is mounted by means of a bolting device 86 to the cylindrical bell cover 87 of spindle 80. Surrounding said gimbal assembly 85 and attached thereto by means of support bearings 89 (shown rotated 90° for clarity) is the gimbal housing 90. The gimbal housing 90 is attached to the base plate 91 of the machine by means of bolting device 92. Thus the gimbal housing 90 provides structural means of attaching the gimbal assembly 85 to the base plate 91 of the photocomposing machine or the like. Attached to said gimbal housing 90 is a yoke assembly 93. Within said yoke assembly 93 and firmly mounted thereto are the actuating means such as solenoids 95 and 96 and the stop members 98 and 99. In other embodiments of the invention the actuating means can be electrical such as stepping motors with various cam arrangements or activation can be achieved by air or fluid means.

In the embodiment shown in FIG. 5, the yoke assembly 93 is attached to the gimbal housing 90 at its lower portion and within the yoke assembly 93 are mounted 180° apart, two solenoids 95 and 96 mounted to their respective yoke legs 101 and 102. Within the yoke assembly 93 and contiguous with the yoke legs 101 and 102 are the stop members 98 and 99. These stop members are configured to provide an accurate and stable stopping and resting location for the gimbal assembly when moved. The gimbal assembly stop member 104 and its counterpart 180° away, stop member 105 (not shown) makes stable contact with stop members 98 and 99. Accordingly, stop members 98 and 99 have adjustable means to vary the stoppers locations so as to accurately calibrate the location of the characters in respect to the optical path of the machine.

Solenoids 95 and 96 have respective moving arms 107 and 108. Moving arms 107 and 108 are attached to the gimbal assembly's slotted yokes 109 and 110, respectively. Upon activation of the solenoids 95 and 96 the moving arm of each solenoid 107 and 108 extend toward or away from the gimbal assembly 85, depending on the desired position of the character storage drum. The movement of the solenoid's moving arms thus causes the gimbal assembly to move to a position such that it is resting against stop member 98 or 99.

I claim:

1. A character storage and retrieval apparatus for use in a phototypesetting machine or the like, for storing characters for selective presentation at a character display location, comprising, a plurality of interchangeable discrete character carriers each said character carrier carrying a plurality of characters from one or more fonts arranged in rows along said character carriers permanently secured thereto and movably disposed for rotation in a closed path of motion along said rows when said photo-type setting machine is in operation, each of said carriers being dimensionally rigid in said closed path of motion, and said characters being selectively positionable in an unobstructed optical path within the boundaries of the dimensionally rigid carrier;

carrier mounting means;

releasable means for attaching each of said character carriers to said carrier mounting means, whereby said character storage apparatus is capable of carrying desired combinations of individually replaceable and dimensionally stable character fonts;

means for moving said carrier mounting means with each of said attached carriers across the direction of rotation and between a first row and another row whereby selected rows of characters for each of said discrete character carriers are selectively positioned in said unobstructed optical path, said moving means consisting of a gimbal assembly upon which said carrier mounting means is attached;

a plurality of bearings, a gimbal housing wherein said gimbal assembly is attached to said gimbal housing by said bearings, a plurality of solenoids, a yoke assembly to which solenoids are mounted, said yoke assembly being attached to said gimbal housing whereby upon actuation of said solenoids, said gimbal assembly is positioned so that the character row can be aligned in said unobstructed optical path.

2. The character storage and retrieval apparatus according to claim 1 wherein said gimbal assembly includes stop means approximately perpendicular to the vertical axis of said gimbal assembly to provide a positioned reference to said gimbal housing in said assembly.

3. The character storage and retrieval apparatus according to claim 2 wherein said bearings attaching the gimbal assembly to the gimbal housing are so attached as to be approximately perpendicular to the vertical axis of said gimbal assembly.

4. The character storage and retrieval apparatus according to claim 2 wherein said solenoids are mounted approximately perpendicular to the vertical axis of said gimbal assembly so as to move the assembly when actuated, approximately perpendicular to the vertical axis of said gimbal assembly.

5. A tilting rotating drum mechanism for use in a phototypesetting machine or the like, for tilting a character storage and retrieval apparatus used for storing characters between a first row and another row aligned in the direction of rotation for selective presentation at a character display location, comprising:

a cylindrical drum;

means to mount a character font on said cylindrical drum;

means to rotate said cylindrical drum continuously and at high speed in alignment with rows of characters;

movable means to support said cylindrical drum and align it with an optical projection line;

housing means to house said movable support means;

means to attach said movable means to said housing means, and means to tilt said movable means between a first row and another row so as to align said character rows with said optical projection line.

6. A tilting drum mechanism according to claim 5 wherein said mounting means for said character font includes individual discrete character carriers.

7. A tilting drum mechanism according to claim 5 wherein said movable means includes a gimbal assembly containing;

a spindle;

a cylindrical structure encircling and attached to said spindle;

a plurality of stop means having a surface confronting outward from said gimbal assembly;

a plurality of slotted yokes containing a surface positioned to confront said stop means to limit the motion of said movable means.

8. A tilting drum mechanism according to claim 7 wherein said housing means includes, a structure encompassing said gimbal assembly having a plurality of support bearing mounting receptacles, said structure being rigidly mountable to the main frame of said photocomposing machine;

a yoke assembly attached to said structure housing the gimbal housing stop members and the means to move said gimbal assembly.

9. A tilting drum mechanism according to claim 7 wherein said means to move said movable means consists of actuating means to move said gimbal assembly from a first position to another position so as to align said characters with an optical projection line.

10. A tilting drum mechanism according to claim 9 wherein said actuating means includes a plurality of solenoids attached to said gimbal assembly and caused upon activation to move said gimbal assembly from a first position to another position.

11. A tilting drum mechanism according to claim 7 wherein said attaching means consists of a plurality of support bearings mounted approximately perpendicular to the vertical axis of said gimbal assembly, between said gimbal assembly and said gimbal housing so as to rotate around its center axis.

* * * * *